US008085940B2

(12) United States Patent
Trautmann et al.

(10) Patent No.: US 8,085,940 B2
(45) Date of Patent: Dec. 27, 2011

(54) REBALANCING OF AUDIO

(75) Inventors: Steven David Trautmann, Tsukuba (JP); Atsuhiro Sakurai, Tsukuba (JP); Ryo Tsutsui, Tsukuba (JP)

(73) Assignee: Texas Instruments Incorporated, Dallas, TX (US)

( * ) Notice: Subject to any disclaimer, the term of this patent is extended or adjusted under 35 U.S.C. 154(b) by 811 days.

(21) Appl. No.: 12/187,884

(22) Filed: Aug. 7, 2008

(65) Prior Publication Data

US 2009/0060203 A1 Mar. 5, 2009

Related U.S. Application Data

(60) Provisional application No. 60/969,033, filed on Aug. 30, 2007.

(51) Int. Cl.
*H04R 5/00* (2006.01)

(52) U.S. Cl. ..... 381/1; 381/2; 381/17

(58) Field of Classification Search ..... 381/1–17
See application file for complete search history.

(56) References Cited

U.S. PATENT DOCUMENTS

| | | | | |
|---|---|---|---|---|
| 5,400,405 | A * | 3/1995 | Petroff | 381/1 |
| 5,440,638 | A * | 8/1995 | Lowe et al. | 381/17 |
| 6,405,163 | B1 * | 6/2002 | Laroche | 381/2 |
| 2006/0083381 | A1 * | 4/2006 | Magrath | 381/17 |
| 2008/0118071 | A1 | 5/2008 | Trautmann et al. | |
| 2011/0116639 | A1 * | 5/2011 | Yamada et al. | 381/17 |

* cited by examiner

*Primary Examiner* — Cuong Q Nguyen

(74) *Attorney, Agent, or Firm* — Mirna Abyad; Wade J. Brady, III; Frederick J. Telecky, Jr.

(57) ABSTRACT

Rebalancing of an audio signal refers to achieving a balance of perceived loudness, typically of right and left channels, given an unbalanced input. A flexible method to automatically rebalance an audio input signal is robust against noise in extreme cases through the individual channels combined in various ways as a function of the loudness ratio between input channels.

3 Claims, 6 Drawing Sheets

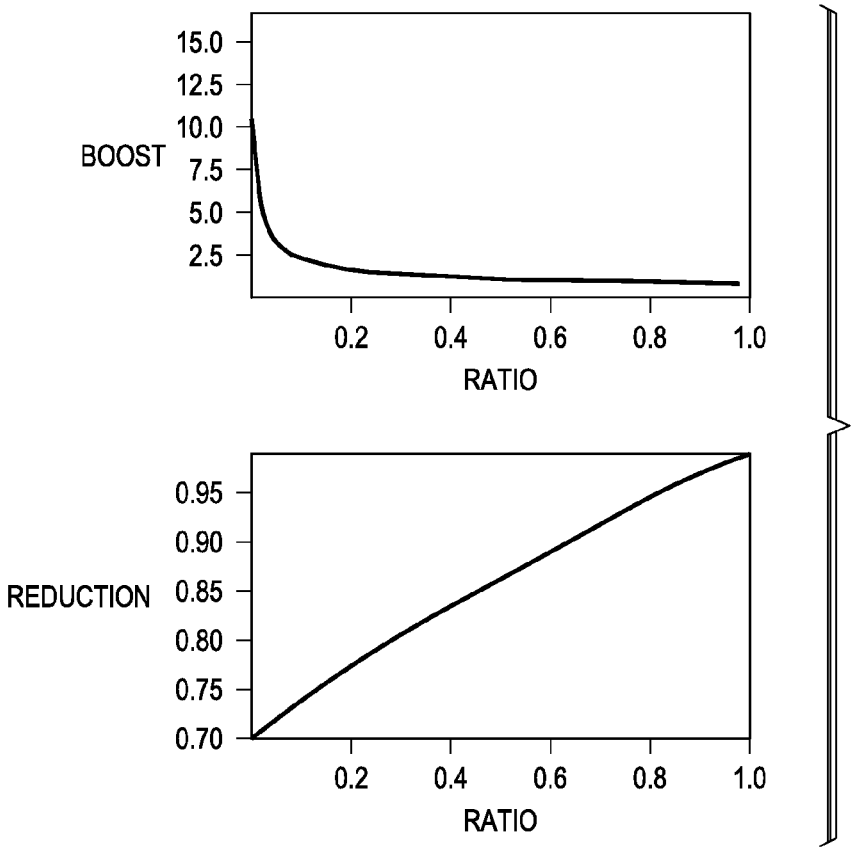
FIG. 1
FIG. 2
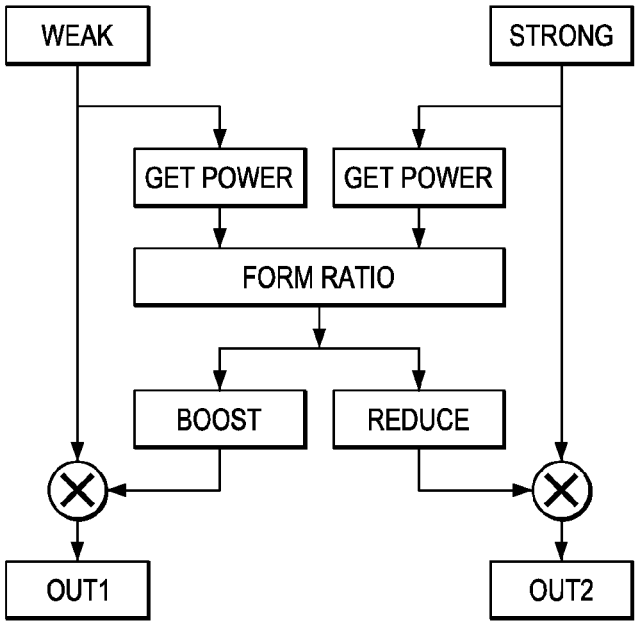

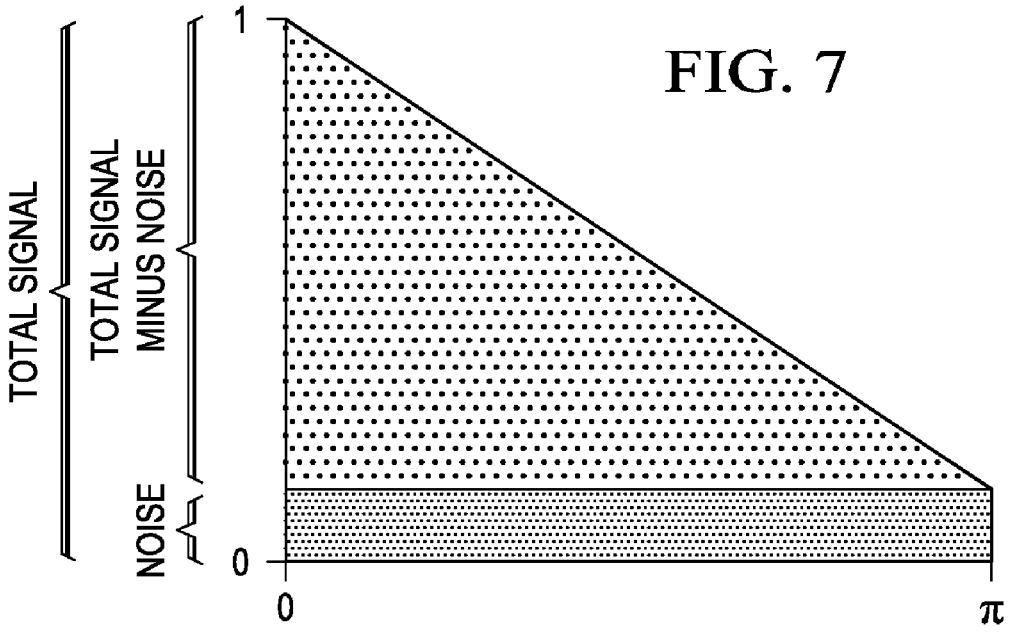
FIG. 7
FIG. 8
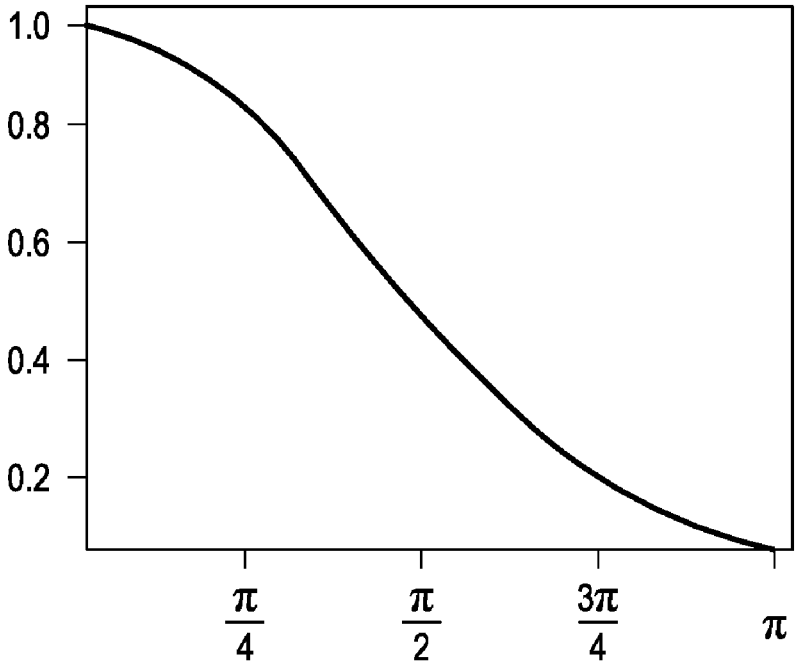

REBALANCING OF AUDIO

CROSS-REFERENCE TO RELATED APPLICATIONS

This application claims priority from provisional application No. 60/969,033, filed Aug. 30, 2007. The following co-assigned, patent applications disclose related subject matter: application Ser. No. 11/560,387, filed Nov. 16, 2006.

BACKGROUND OF THE INVENTION

The present invention relates to digital signal processing, and more particularly to multi-channel audio output.

Balance in audio often refers to the ratio of loudness between two signals, typically right and left stereo channels. For instance many stereo hardware components have a knob labeled "balance" to control the loudness ratio of the two speakers. Automatic rebalancing refers to the automatic adjustment of an input signal to achieve nearly equal loudness levels at the outputs. This is useful in the case of, for instance, listening to poorly recorded or poorly mixed music, as is sometimes the case for old LPs, tapes and even CDs.

The basic goal of achieving balance can be attained by adjusting one channel to match the loudness of another. An additional worthwhile goal is to maintain the overall loudness, i.e. the rebalancing should not affect the overall perceived loudness. Another additional goal is to be robust against highly unbalanced signals. If one channel has a very low level, it might require a large increase in loudness, which can lift the noise floor and reduce the overall signal to noise ratio. Also, it may be the case that there is no signal at all on one of the channels. These are problems for known balancing methods.

SUMMARY OF THE INVENTION

The present invention provides audio balancing with contingent sharing of a strong channel signal with a weak channel signal.

BRIEF DESCRIPTION OF THE DRAWINGS

FIG. 1 is a graph of boost and reduce.
FIG. 2 shows a system.
FIG. 7 is a signal plus noise spectrum.
FIG. 8 is a filter frequency response.

DESCRIPTION OF THE PREFERRED EMBODIMENTS

1. Overview

Preferred embodiment two-channel audio balancing methods include using one input channel to derive both output channels when the other input channel has a very weak or no signal. Also, preferred embodiment methods can balance multi-channel systems where one or more channels have very weak or no input signal by sharing the stronger channel signals to derive output signals for the weak/no-input channels.

Figure 9:
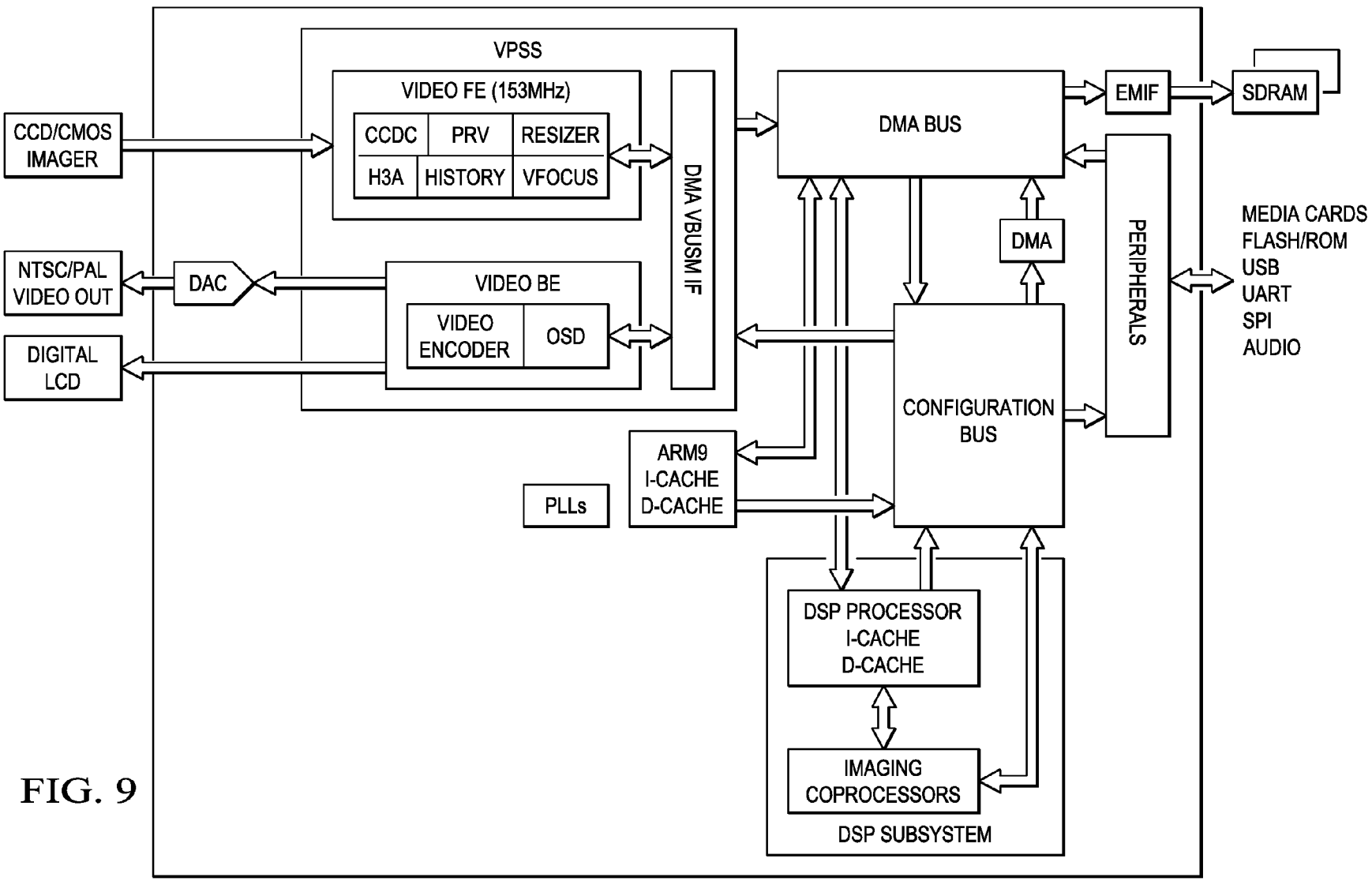
FIG. 9 shows a processor.

Preferred embodiment application systems (e.g., cellphones, PDAs, portable audio players, etc.) perform preferred embodiment methods with any of several types of hardware: digital signal processors (DSPs), general purpose programmable processors, application specific circuits, or systems on a chip (SoC) such as combinations of a DSP and a RISC processor together with various specialized programmable accelerators. FIG. 9 is an example of an audio-visual processor. A stored program in an onboard or external (flash EEP) ROM or FRAM could implement the signal processing. Analog-to-digital converters and digital-to-analog converters can provide coupling to the real world, modulators and demodulators (plus antennas for air interfaces) can provide coupling for transmission waveforms, and packetizers can provide formats for transmission over networks such as the Internet.

2. Boost and Reduce

Since loudness is closely associated with power (i.e. can be defined in terms of power), it makes sense to adjust loudness by adjusting power. Furthermore the goal of maintaining the total loudness can basically be achieved by maintaining total power. In MIDI, for instance, the panning curves are designed to maintain constant total power. Suppose the average power of a signal x is measured over N samples, by $$\text{power}(x) = \frac{\sum_{i=0}^{N-1} x[i]^2}{N}. \tag{1}$$

We would like a pair of gain adjustments b and r (i.e., boost and reduce) so that the weaker signal is boosted and the stronger signal is reduced to achieve balance while preserving the original total power. Writing these requirements mathematically gives $$\frac{\sum_{i=0}^{N-1} (bx_{weak}[i])^2}{N} = \frac{\sum_{i=0}^{N-1} (rx_{strong}[i])^2}{N} \tag{2}$$

which insures the adjusted signals are in balance, and $$\frac{\sum_{i=0}^{N-1} (bx_{weak}[i])^2}{N} + \frac{\sum_{i=0}^{N-1} (rx_{strong}[i])^2}{N} = \frac{\sum_{i=0}^{N-1} (x_{weak}[i])^2}{N} + \frac{\sum_{i=0}^{N-1} (x_{strong}[i])^2}{N} \tag{3}$$

which insures the total power is the same as before.

Let $$S_s = \text{power}(x_{strong}) = \frac{\sum_{i=0}^{N-1} (x_{strong}[i])^2}{N} \tag{4}$$

and $$S_w = \text{power}(x_{weak}) = \frac{\sum_{i=0}^{N-1} (x_{weak}[i])^2}{N} \tag{5}$$

Equations (2) and (3) imply that $$b^2 \cdot S_w = r^2 \cdot S \tag{6}$$

and $$b^2 \cdot S_w + r^2 \cdot S_s = S_w + S_s. \tag{7}$$

Defining $$\text{ratio} = \frac{S_w}{S_s} \tag{8}$$

gives a value between 0 and 1.

Dividing (6) and (7) by $S_s$ gives $$b^2 \cdot \text{ratio} = r^2 \tag{9}$$

and $$b^2 \cdot \text{ratio} + r^2 = \text{ratio} + 1. \tag{10}$$

Substituting (9) into (10) gives $$2r^2 = \text{ratio} + 1 \tag{11}$$

and $$2b^2 \cdot \text{ratio} = \text{ratio} + 1. \tag{12}$$

Thus $$r = \sqrt{\frac{\text{ratio} + 1}{2}} \tag{13}$$

and $$b = \sqrt{\frac{\text{ratio} + 1}{2\ \text{ratio}}}. \tag{14}$$

Given this discussion, two functions can be defined as follows:

$$\text{boost}(v) = \sqrt{\frac{v+1}{2v}} \tag{15}$$

$$\text{reduce}(v) = \sqrt{\frac{v+1}{2}}. \tag{16}$$

Feeding the power ratio vinto these functions gives gain values to be used to boost the weaker signal and reduce the stronger signal. As desired, the resulting pair of signals will have equal power; and the sum of the powers is the same as the sum of the original unbalanced signals' powers. A graph of (15) and (16) is shown in FIG. 1.

A block diagram of this approach is shown in FIG. 2.

In the case of more than 2 unequal channels, it will be unclear which channels will require boosting or reducing. Also, although the loudest channel will need some reduction and the quietest channel will require some boost, there are no one-parameter formulas for determining the amounts. Instead, since maintaining total power is desired, and the power of each of some number M channels must be made equal, the power on channel n is adjusted by the channel signal $x_n$ by $$adjust_n \sqrt{\frac{\sum_{i=1}^{M} \text{power}(x_i)}{M} \cdot \frac{1}{\text{power}(x_n)}}. \tag{17}$$

3. Weighting Functions

Although power can be used to approximate perceived loudness, the human ear is less sensitive to low and high frequencies. Thus if the spectrum of the input channels is significantly different, other loudness approximations are better than power alone. Three popular frequency weights, called A, B and C, which de-emphasize low and high frequencies were defined in 1976 ANSI Specifications for Sound Level Meters. These or other weightings may be applied instead using power only. Thus all mentions of power can be taken to mean, power with or without a weighting function applied.

4. First Preferred Embodiment

Although the functions given in (15) and (16) can theoretically balance any pair of signals as long as neither of the signals is 0 (everywhere), in practice boosting a very weak signal by a large amount increases the noise level. Furthermore, there is no guarantee that all of the signals are non-zero. Assume there is at least one 0 channel. If all the channels are 0, then they are in balance. Therefore, it is safe to assume there is at least one non-zero channel. In that case, for the output channels to balance, the 0 channels need to be generated from the remaining non-zero channels. For instance, in the case of stereo, if one channel is 0, the reduce function (16) can still be applied to the non-zero channel and the scaled signal can be given to both outputs. However, this is just a power-preserving mono-to-stereo conversion. A more interesting output for the mono-to-stereo conversion problem may be achieved by a method such as in cross-referenced application Ser. No. 11/560,387 which separates high-, mid-, and low-frequency bands, and delays and attenuates to create virtual separation of higher and lower frequency sources.

Even in the case where a weak channel is not 0, it may still be good to add some signal from another channel or channels in order to reduce noise. In the 2-channel case where all the noise is quantization noise at the same level on each channel prior to balancing, the total noise power after boosting the weak signal and reducing the strong signal is at least $$\text{total_noise_power} \approx (\text{boost}(v)^2 + \text{reduce}(v)^2) \cdot \text{quantization_noise_power}. \tag{18}$$

However, if the output of the reduced channel cannot also reduce quantization noise, which is typically the case, a more accurate formula for total noise power is $$\text{total_noise_power} \approx (\text{boost}(v)^2 + 1) \cdot \text{quantization_noise_power}. \tag{19}$$

The resulting signal to noise ratio (SNR) is therefore $$SNR \approx \frac{\text{boost}(v)^2 \cdot \text{power}(x_{weak}) + \text{reduce}(v)^2 \cdot \text{power}(x_{strong})}{(\text{boost}(v)^2 + 1) \cdot \text{quantization_noise_power}}. \tag{20}$$

Figure 3:
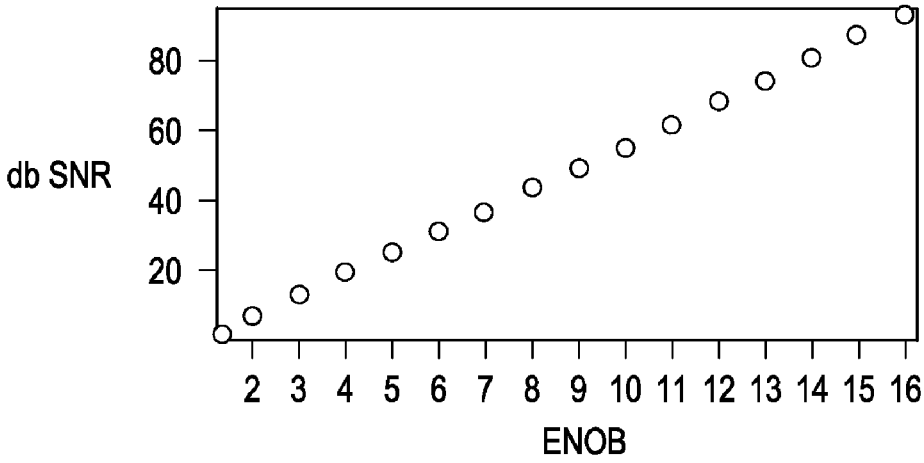
FIG. 3 is a graph of SNR.

A graph based on (20) of the SNR on a dB scale as determined by different effective number of bit (ENOB) ranges on the weak channel is nearly linear as shown in FIG. 3. The stronger channel is assumed to be the best case in 16-bit audio where ENOB=16.

To improve the output in the case where a channel is missing or very weak, some of the stronger channel can be mixed with the weaker channel. A first preferred embodiment block diagram for the 2-channel case is shown in FIG. 4.

Figure 4:
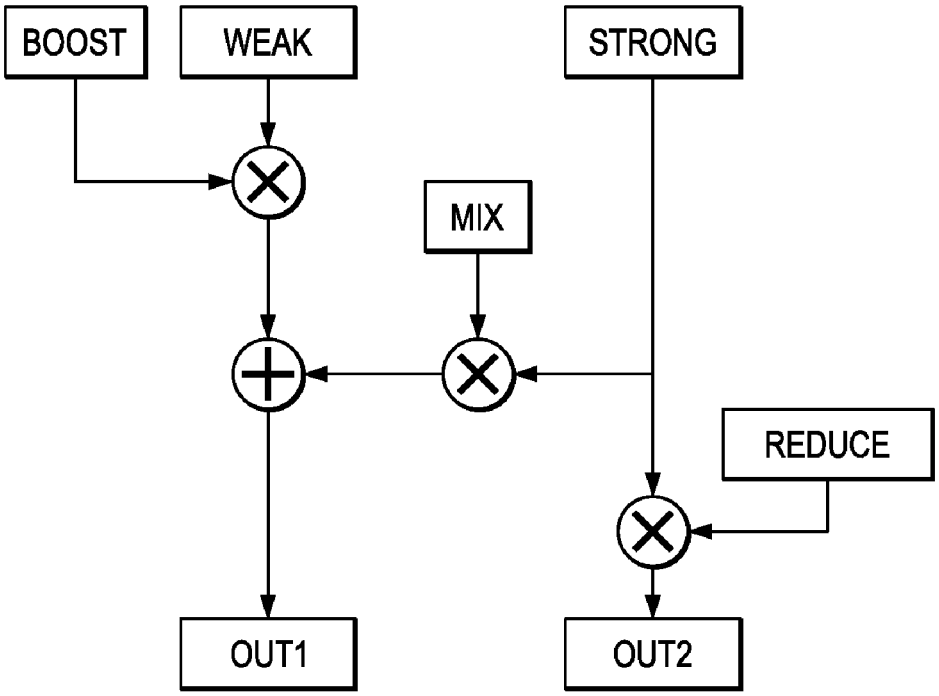
FIG. 4 illustrates a first preferred embodiment.

In the FIG. 4 model some of the stronger channel is simply mixed with the weaker channel prior to output. To make sure the output is balanced and equal (in power) to the input, the formula for boost (15) cannot be used without modification. The new formulas for the boost and mix factors in the FIG. 4 model can be derived assuming there is some tolerable SNR of N dB. Assume the SNR on the stronger channel is greater than N dB. If the SNR from equation (20) is also greater than or equal to N dB, the system in FIG. 2 is used. In that case boost is calculated from equation (15), reduce is calculated from equation (16) and mix is 0.

The SNR is defined as the total signal divided by the noise portion on a dB scale.

Letting b=boost, m=mix, r=reduce in FIG. 4, and letting $S_s$=power($x_{strong}$), $S_w$=power($x_{weak}$), $N_x$=power($noise_{strong}$), and $N_w$=power($noise_{weak}$), (note that the noise is not necessarily quantization noise) the SNR from the system in FIG. 4 can be written as $$SNR = 10\log_{10}\left(\frac{b^2 \cdot S_w + m^2 \cdot S_s + r^2 \cdot S_s}{b^2 \cdot N_w + m^2 \cdot N_s + r^2 \cdot N_s}\right). \tag{21}$$

Let $$K = 10^{\left(\frac{SNR}{10}\right)} = \frac{b^2 \cdot S_w + m^2 \cdot S_s + r^2 \cdot S_s}{b^2 \cdot N_w + m^2 \cdot N_s + r^2 \cdot N_2}. \tag{22}$$

Also to preserve power there is $$b^2 \cdot S_w + m^2 \cdot S_s + r^2 \cdot S_s = S_w + S_s \tag{23}$$

so $$K = \frac{S_w + S_s}{b^2 \cdot N_w + m^2 \cdot N_s + r^2 \cdot N_s}. \tag{24}$$

Also, for the outputs to balance, there is $$b^2 \cdot S_w + m^2 \cdot S_s = r^2 + S_s \tag{25}$$

so that $$b^2 = \frac{r^2 \cdot S_s - m^2 \cdot S_s}{S_w} \tag{26}$$

and $$m^2 = \frac{r^2 \cdot S_s - b^2 \cdot S_w}{S_s}. \tag{27}$$

Substituting from (27) into (24) gives $$S_w + S_s = K\left(b^2 \cdot N_w + \left(\frac{r^2 \cdot S_s - b^2 \cdot S_w}{S_s}\right) \cdot N_s + r^2 \cdot N_s\right) \tag{28}$$

so $$S_w + S_s = b^2 \cdot \left(K \cdot N_w - \frac{K \cdot S_w \cdot N_2}{S_s}\right) + r^2 \cdot K \cdot N_s + r^2 \cdot K \cdot N_s \tag{29}$$

and so finally $$b^2 = \frac{S_w + S_s - 2 \cdot r^2 \cdot K \cdot N_s}{K \cdot \left(N_w - \frac{S_w \cdot N_s}{S_s}\right)}. \tag{30}$$

Likewise substituting from (26) into (24) gives $$S_w + S_s = K\left(\left(\frac{r^2 \cdot S_s - m^2 \cdot S_w}{S_w}\right) \cdot N_w + m^2 \cdot N_s + r^2 \cdot N_s\right) \tag{31}$$

so $$S_w + S_s = m^2 \cdot \left(K \cdot N_s - \frac{K \cdot S_s \cdot N_w}{S_w}\right) + r^2 \cdot K \cdot \left(\frac{S_s \cdot N_w}{S_w} + N_s\right) \tag{32}$$

and so finally $$m^2 = \frac{S_w + S_s - r^2 \cdot K \cdot \left(\frac{S_s \cdot N_w}{S_w} + N_s\right)}{K \cdot \left(N_s - \frac{S_s \cdot N_w}{S_w}\right)}. \tag{33}$$

In summary, determine the reduce, boost, and mix of FIG. 4 as follows:

$$\text{reduce} = \sqrt{\frac{\left(\frac{S_w}{S_s}\right) + 1}{2}} \tag{34}$$

$$\text{boost} = \sqrt{\frac{S_w + S_s - 2 \cdot reduce^2 \cdot K \cdot N_s}{K \cdot \left(N_w - \frac{S_w \cdot N_s}{S_s}\right)}} \tag{35}$$

$$\text{mix} = \sqrt{\frac{S_w + S_s - reduce^2 \cdot K \cdot \left(\frac{S_s \cdot N_w}{S_w} + N_s\right)}{K \cdot \left(N_s - \frac{S_s \cdot N_w}{S_w}\right)}} \tag{36}$$

where K is determined by the target SNR using the first part of equation (22).

For example, if the ENOB on the weaker channel is 13 bits and the ENOB on the stronger channel is 16 bits, then the SNR on the weaker channel is 78.26 dB while the stronger channel has SNR of 96.33 dB. If the minimum for "CD quality" is an SNR of 83 dB, then the factors derived from equations (15) and (16) are reduce=0.71 and boost=5.7. However the SNR achieved using these factors is only 81.21 dB. However, using the target SNR to determine K and the reduce factor from (34) and then equations (35) and (36) give the factors boost=4.6 and mix=0.42. Applying these in the system shown in FIG. 4 gives balanced output with the same total power and SNR of 83 dB.

Note that equations (35) and (36) do not work when the weak signal has 0 power. Therefore, this should either be treated as a special case, or a small "epsilon" value can be used instead of 0.

Equations (35) and (36) make no assumptions about the amount of noise and work well in general. However, if the noise is due to quantization error and the same number of bits is used at input and output, then the reduction in the stronger channel will decrease the SNR in that channel (while boosting the weaker channel will preserve the SNR in that channel). If all noise is assumed to be irreducible quantization noise equations (35) and (36) can be modified by substituting 1 for all $reduce^2 \cdot N_s$ terms, and then substituting 1 for $N_w$ and for $N_s$ as follows:

$$\text{boost} = \sqrt{\frac{S_w + S_s - 2 \cdot K \cdot 1}{K \cdot \left(1 - \frac{S_w \cdot 1}{S_s}\right)}} \tag{37}$$

$$\text{mix} = \sqrt{\frac{S_w + S_w - K \cdot reduce^2 \cdot \left(\frac{S_s \cdot 1}{S_w}\right) - K}{K \cdot \left(1 - \frac{S_s \cdot 1}{S_w}\right)}}. \tag{38}$$

While equations (34) through (38) show how to mix the strong channel with the weak channel in order to achieve a desired SNR, just mixing the stronger channel with the weaker is not very interesting aurally, and tends to rely too much on the stronger signal.

5. Second Preferred Embodiment

Figure 5:
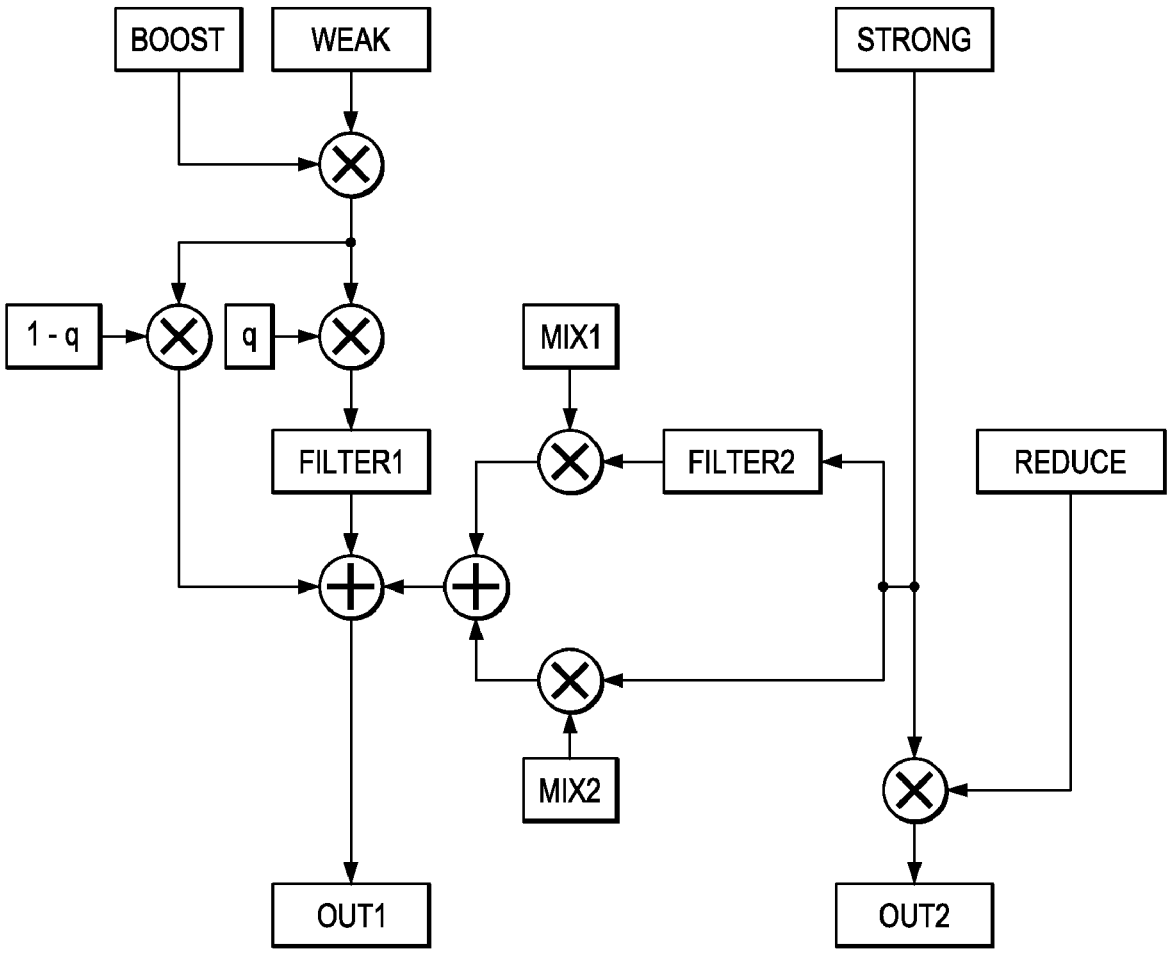
FIG. 5 shows a second preferred embodiment.

To increase the amount of weaker signal retained, a second preferred embodiment system such as shown in FIG. 5 can be used.

In FIG. 5, filter1 can be a low-pass filter since for most audio signals, the desired signal is concentrated on the low end of the frequency spectrum while the noise is often evenly distributed in frequency. In order to maintain spectral balance, filter2 can be a high-pass filter. Since the strong input signal presumably has less noise, mixing the two filtered signals can improve the SNR on the weak channel. Although any filters can in principle be used, a simple one-zero filter implementation can be used for both the low-pass filter1 and high-pass filter2. It is then easy to make the filters complementary by using opposing zero locations. Unfortunately the SNR improvement using this scheme is signal dependent, but by making some simple assumptions about the nature of the audio signal a maximum improvement can be estimated as about 1.46 dB as follows.

Consider the signal shown in FIG. 7 where the power of the noise portion is distributed evenly in frequency, while the power of the non-noise portion decreases linearly to 0 at the Nyquist frequency labeled 'π'. A simple low-pass with one zero at the Nyquist frequency of 'π' (a two-point averaging filter) has a frequency response which corresponds to a raised cosine, shown if FIG. 8. Applying this filter to the signal described will reduce the noise to 0.5 of the original level while reducing the non-noise signal to about 0.7 of the original level. This corresponds to 1.46 dB improvement for SNR, and means 40% more of the weak signal can be included in FIG. 4 for the same amount of noise.

One strategy for filter1 and filter2 is to use them as the first line of defense against SNR tolerance breaches. In this approach, for signals where using equations (15) and (16) to determine boost and reduce is satisfactory, then mix1 is 0, mix2 is 0, and q is 0. When the SNR tolerance is breached, boost, mix and q in FIG. 5 are calculated as follows. Let $$K = 10^{\left(\frac{target_SNR}{10}\right)} \tag{39}$$

$$r = \sqrt{\frac{1}{2}\left(\frac{S_w}{S_s} + 1\right)} \tag{40}$$

$$b = \sqrt{\frac{1}{2}\left(\frac{\frac{S_w}{S_s} + 1}{\frac{S_w}{S_s}}\right)} \tag{41}$$

with r and b corresponding to the reduce and boost amounts in equations (15) and (16), and are used as such in FIG. 5. Also define $$\alpha = \frac{c_1(S_w - N_w) + c_2 N_w}{S_w} \tag{42}$$

$$\beta = \frac{c_3(S_s - N_s) + c_4 N_s}{S_s} \tag{43}$$

where $c_1$, $c_2$ indicate how much filter1 in FIG. 5 reduces the signal without noise and noise respectively, and where $c_3$, $c_4$ indicate how much filter2 in FIG. 5 reduces the signal without noise and noise respectively. Using α and β is necessary since $S_w$ contains both signal and noise, while the effect of the filters on these components are different. Thus the effect of the filters can be described as $$b^2(1-\alpha q)S_w + m^2\beta S_s = r^2 S_s \tag{44}$$

and $$b^2(1 - c_2 q)N_w + m^2 c_4 N_s + r^2 N_s = \frac{S_w + S_s}{K} \tag{45}$$

where m corresponds to mix1 in FIG. 5 and q controls the amount of low pass filtering applied to the weak signal, with q=0 indicating no filtering and q=1 indicating complete filtering. Then if $0 \leqq q \leqq 1$, from (44) and the fact that $b^2 S_w = r^2 S_s$ there is $$m = \sqrt{\frac{b^2 \alpha q S_w}{\beta S_s}} \tag{46}$$

which gives mix1, while mix2 is set to 0. Substituting (46) into (45) gives $$q = \frac{\left(\frac{S_w + S_s}{K} - r^2 N_s - b^2 N_w\right)}{\left(\frac{c_4 b^2 \alpha S_w N_s}{\beta S_s} - c_2 b^2 N_w\right)}. \tag{47}$$

However, if q>1 then the filter1 and filter2 combination in FIG. 5 is effectively maxed-out. Therefore additional calculations are required to obtain the proper values for boost, mix1, mix2 and q. First fix q at 1. Then introduce $m_a$, to help represent mix2 in FIG. 5, and k, which helps determine the ratio of mix1 to mix2, into (44) and (45) as follows $$\frac{b^2(1-\alpha)S_w + m^2\beta S_s + km_a^2 S_s}{1+k} = r^2 S_s. \tag{48}$$

$$\frac{b^2(1-c_2)N_w + m^2 c_4 N_s + km_a^2 N_s}{1+k} = \frac{S_w + S_s}{K} - r^2 N_s. \tag{49}$$

Then $$m_a^2 = \frac{(1+k)r^2 S_s - b^2(1-\alpha)S_w - m^2\beta S_s}{kS_s} \tag{50}$$

and $$b^2(1-c_2)N_w + m^2 c_4 N_s + \frac{(1+k)r^2 S_s - b^2(1-\alpha)S_w + m^2\beta S_s}{S_s}\cdot N_s = (1+k)\left(\frac{S_w + S_s}{K} - r^2 N_s\right) \tag{51}$$

so $$(1+k)\left(2r^2 N_s - \frac{S_w + S_s}{K}\right) = \frac{(b^2(1-\alpha)S_w - m^2\beta S_s)N_s}{S_s} - b^2(1-c_2)N_w - m^2 c_4 N_s \tag{52}$$

and finally $$k = \frac{\frac{(b^2(1-\alpha)S_w + m^2\beta S_s)N_s}{S_s} - b^2(1-c_2)N_w - m^2 c_4 N_s - 2r^2 N_s + \frac{S_w + S_s}{K}}{2r^2 N_s - \frac{S_w + S_s}{K}} \tag{53}$$

Lastly, set $$b_1 = \sqrt{\frac{b^2(1-\alpha)}{1+k}} \tag{54}$$

and use it in FIG. 5 as the new boost amount, set $$m_1 = \sqrt{\frac{m^2\beta}{1+k}} \tag{55}$$

and use it as the new mix1, and set $$m_2 = \sqrt{\frac{k\left(\frac{(1+k)r^2}{k} - \frac{b^2(1-\alpha)S_w + m^2\beta S_s}{kS_s}\right)}{1+k}} \tag{56}$$

and use it as the new mix2 so that equation (48) becomes $$b_1^2(1-\alpha)S_w + m_1^2\beta S_s + m_2^2 S_s = r^2 S_s. \tag{57}$$

6. Third Preferred Embodiment

Although the system in FIG. 5 is an improvement on FIG. 4, in the extreme case where the weak signal is missing, filter2 becomes all-pass and again the output is just the same scaled strong signal on both channels. In such a case, better mono-to-stereo conversion programs may be desired. A system that allows this to be used is shown in FIG. 6.

Figure 6:
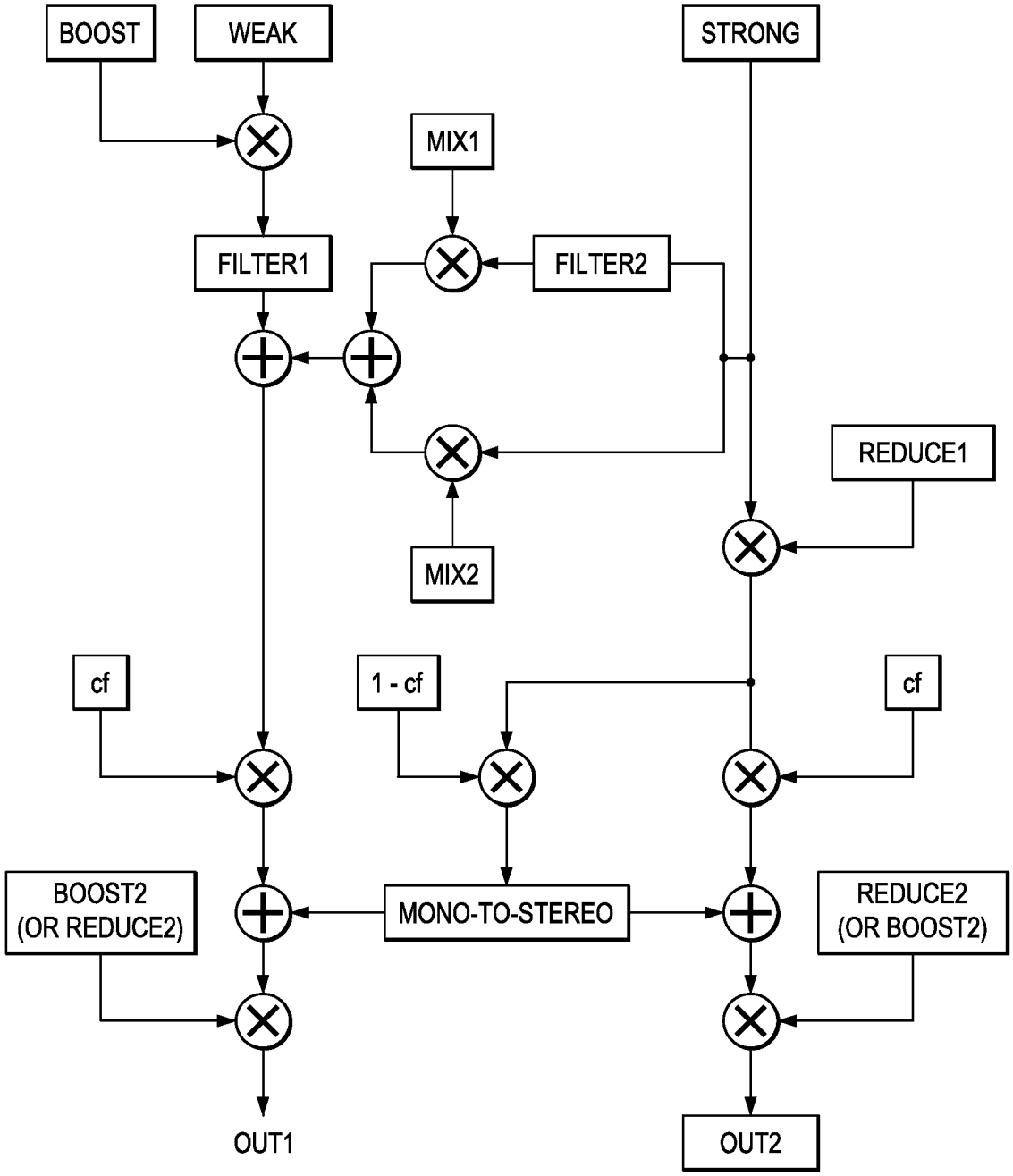
FIG. 6 illustrates a third preferred embodiment.

In FIG. 6, "cf" stands for a cross-fade factor, which allows a transition between the techniques used in FIG. 6 and a mono-to-stereo conversion (for example, in the cross-referenced patent application). Generally, the cf factor would be equal to 1 or very close to 1, unless the weak channel is extremely weak or missing completely. Note that when the weak channel is missing completely cf should be set to 0, and the calculations for boost, filter1, mix1, mix2 and filter2 need not be carried out. However, the exact value cf takes as a function of the inputs in other circumstances can be left as a design parameter. After the addition of the scaled mono-to-stereo signal to both channels, the output signals should be fairly well balanced. However, if the output channels are not exactly balanced, a second boost factor may be applied to the weaker channel and a second reduce factor may be applied to the stronger channel.

What is claimed is:

1. A method of stereo balancing, comprising the steps of:

(a) providing a first channel input and a (stronger) second channel input;

(b) computing a first power of said first channel input and a second power of said second channel input;

(c) computing a boost factor, a reduce factor, and a mix factor using the results of said computing of step (b);

(d) computing a first channel output as the sum of (i) a product of said first channel input with said boost factor plus (ii) a product of said second channel input with said mix factor; and (e) computing a second channel output as the product of said second channel input with said reduce factor.

2. The method of claim 1, wherein as computing a boost factor includes a target output signal-to-noise ratio.

3. A method of stereo balancing, comprising the steps of:

(a) providing a first channel input and a (stronger) second channel input;

(b) computing a first power of said first channel input and a second power of said second channel input;

(c) computing a boost factor, a reduce factor, a first mix factor, a second mix factor, and a filter factor using the results of said computing of step (b);

(d) computing a first channel intermediate signal as the sum of (i) a product of said first channel input with said boost factor and with 1 minus said filter factor plus (ii) a low pass filtering of a product of said first channel input with said boost factor and with said filter factor;

(e) computing a second channel mixture as the sum of (i) a product of said second channel input with said first mix factor and (ii) a product of said second channel input after highpass filtering with said second mix factor;

(f) computing a first channel output as the sum of (i) said first channel intermediate signal and (ii) said second channel mixture; and (g) computing a second channel output as the product of said second channel input with said reduce factor.

* * * * *